US005145287A

United States Patent [19]

Hooper et al.

[11] Patent Number: 5,145,287

[45] Date of Patent: Sep. 8, 1992

[54] PLASTIC PANEL EROSION BARRIER

[75] Inventors: Jefferson E. Hooper, Lake Arthur, La.; John E. Irvine, Granger, Ind.

[73] Assignee: Materials International, Inc., Lake Charles, La.

[21] Appl. No.: 667,273

[22] Filed: Mar. 11, 1991

[51] Int. Cl.[5] ..... E02D 7/20; E02D 5/00

[52] U.S. Cl. ..... 405/242; 405/274; 405/284

[58] Field of Search ..... 405/262, 277, 278, 274, 405/284, 285, 258, 281

[56] References Cited

U.S. PATENT DOCUMENTS

| | | | |
|---|---|---|---|
| 972,059 | 10/1910 | Clarke . | |
| 1,422,821 | 7/1922 | Boardman et al. . | |
| 1,679,800 | 8/1928 | Wemlinger | 405/281 |
| 1,884,686 | 10/1932 | Hilpert | 405/281 |
| 2,090,728 | 8/1937 | Heide | 405/278 |
| 2,968,931 | 6/1961 | McGrath . | |
| 3,247,673 | 4/1966 | Schneller . | |
| 3,822,557 | 7/1974 | Frederick . | |
| 3,999,392 | 12/1976 | Fukushima et al. | 405/281 |
| 4,480,945 | 11/1984 | Schnebel, Jr. | 405/262 |
| 4,494,892 | 1/1985 | Wojciechowski | 405/262 X |
| 4,674,921 | 6/1987 | Berger | 405/262 |
| 4,690,588 | 9/1987 | Berger | 405/262 |
| 4,863,315 | 9/1989 | Wickberg | 405/278 |

*Primary Examiner*—Dennis L. Taylor

*Attorney, Agent, or Firm*—Charles F. Schroeder

[57] ABSTRACT

A plastic structural panel and ground erosion barrier made therefrom in which the panel is in strip form relatively narrow compared to its length and which in general is a stretched Z-shaped cross sectional design with opposed male and female interlock edges for mating association with adjacent panel strips. The panel strip design has a "V" configuration on opposite faces and allows optional top-to-top alignment of adjacent panels for a composite deep "V" cross sectional shaped wall or alternate top-to-bottom turnover of adjacent panel strips to provide a thicker box ribbed cross sectional shape for the wall. The composite deep V-shaped cross section provides a greater breadth of coverage but less section modulus than the box ribbed construction. By incorporating in the design a capability of a slight flex in the panel and by forming the female interlock sections with a gap allowing alignment of adjacent panels with a small angular degree orientation, a number of wall bends or configurations can be imparted to wall constructions without need for extra components or different shaped panel strips for bends or nonconformities in alignment of the wall construction.

13 Claims, 3 Drawing Sheets

PLASTIC PANEL EROSION BARRIER

FIELD OF THE INVENTION

This invention is a structural ground retaining construction adaptable to use for seawalls, ground erosion barriers and the like incorporating a relatively narrow, light weight extrusion molded structural plastic panel or panel strip having a cross sectional configuration which allows construction of walls in either of two different cross sectional shapes and structural strengths.

The panel strip has a stretched generally broad Z-shaped cross section with opposite male and female interlockable edges for establishing an interlocking association with adjacent similar panels in a wall construction.

Seawalls and like erosion protection walls in the past have usually been made of steel to stand against high waves in the order of 30 feet or more at ocean or large lake shorelines. To utilize such heavy protection in the many hundreds of thousands of miles of shoreline of inland lakes, rivers and streams however is much beyond practical needs and would be exorbitant both in cost of material as well as labor and equipment required for construction and installation of such walls. Accordingly there is considerable, if not extreme, need for a low cost and more readily installable type erosion protection wall within the range of installation by the numerous small business and individual land owners on lakes and rivers who are confronted with erosion problems. Many can only afford small close-to-home construction contractors or do-it-yourself type installations not involving the cost of heavy equipment such as heavy pile drivers and automatic impact hammers and vibrators, let alone the equipment required to lift and handle heavy panels of steel or other metal wall constructions.

It is known in the art to make seawall constructions of corrugated plastic panel strips with interlocking edges which lend themselves to formation of walls of commercially available relatively thin undulating cross section such as are disclosed in U.S. Pat. Nos. 4,674,921 and 4,690,588. Such a system of corrugated panels has limited section modulus or bulk modulus in assembly with various soil and ground conditions with which it is associated. That is, barrier walls of such corrugated panels are relatively thin in depth and provide no selectible accommodation to the needs of special ground conditions requiring strength in the panel construction but relies more heavily if not almost entirely upon anchoring techniques for wall strength.

SUMMARY OF THE INVENTION

The invention herein disclosed is a plastic panel strip of stretched Z-shaped cross sectional design with opposed male and female interlock edges for mating association with adjacent panel strips. The panel strip design incorporates a "V" configuration on opposite faces which allows optional interlocked alignment to provide a wall having either a secondary deep V-shaped cross section or a box ribbed cross sectional shape formed of pairs of adjacent panel strips. The panel shape and edge interlock design permits top to top alignment of adjacent panels for the deep V-shaped cross section or alternate top to bottom turnover of adjacent panel strips to provide the thicker box ribbed cross sectional shape to the wall. The deep "V" wall shape made of the panel strip has less depth and less section modulus than the box ribbed construction, but provides greater breadth of coverage for a given number of panels than is provided by the box rib construction. In other words for a given length of wall made with the panel strips more panel strips are required with the box rib construction than with the deep "V" construction.

The top to bottom reversal of the alternate panels of the box rib construction is made possible because of the interlock shape in which the male portion extends outwardly at the edge of the panel in symmetrical form on opposite sides of the edge of the wall while similarly the mating female portion, which is larger to accommodate the male interlock edge, also extends outwardly and symmetrically on both sides of the edge of the wall. This forms a partial circle at the female edge portion within which the male portion of an adjacent strip can be interlocked during installation of a bulkhead wall by insertion of the bottom of the panel therein and then sliding the panel edge downwardly in nested relation within the female portion until force is necessary to push the panel into the ground, frequently under water, in which it is embedded in place.

The cross sectional shape of the panel strip is described as a stretched Z-shaped cross section, in that the side sections extending from opposite sides of the central body section extend from the body with an obtuse angle therebetween, in other words with an angle therebetween greater than 90 degrees. The side sections extending in opposite directions from the central body section extend in directions generally parallel to each other but with an oppositely facing obtuse angle therebetween. In practice the angle between the body and the leg portions is found to be preferably in the order of 120 degrees.

The panel strips because of their shape, individually have a section modulus of fair magnitude across their length, but in assembly with adjacent panel strips have a greater stiffness and section modulus as hereinafter explained. Although, relatively rigid to bending across their length they can be made of thickness providing a degree of springiness which allows a desirable slight degree of lateral flex without reaching a yield strength or appreciably affecting structural properties, thereby facilitating formation of bends in barrier walls formed of the panel strips.

It is an object of the invention to provide a light weight, easy to handle plastic panel strip adaptable to making a ground erosion barrier for seawalls and the like which will withstand soil shifts, weather changes and wave action.

Another object of the invention is to provide a plastic panel strip designed with edge interlocks which permit alternate inversion of panel strips to selectably form wall constructions of different cross sectional shapes and strength with the single shaped panel strip.

Still another object of the invention is to provide a panel strip system of assembly into an erosion resistant wall in which the panel strips can be interlocked to any of a wide range of angular linear orientations including right angular turns without need for specially shaped additional strips or connecting sections.

A feature of the invention is the ease with which the plastic panel in strip widths can be handled because of their relatively light weight.

Another feature of the invention is its ability of the panel strips in multiple assembly to provide bends and corners in wall constructions without need for special fittings, corner adapters or panel strips of different shape.

Still another feature of the invention is the slight lateral bendability or capability of the panel strips to be flexed laterally across their width to further assist in enabling the assembly of panel strips into a barrier capable of meeting a wide range of linear contours to match the numerous irregularities confronted in building, ground and shore line barrier constructions.

Other objects and features which are characteristic of the invention are set forth with particularity in the appended claims. The invention, however, both in organization and construction, together with further objects and features thereof may be best understood by reference to the following description taken in connection with the accompanying drawings.

THE DRAWINGS

Figures 3, 4:
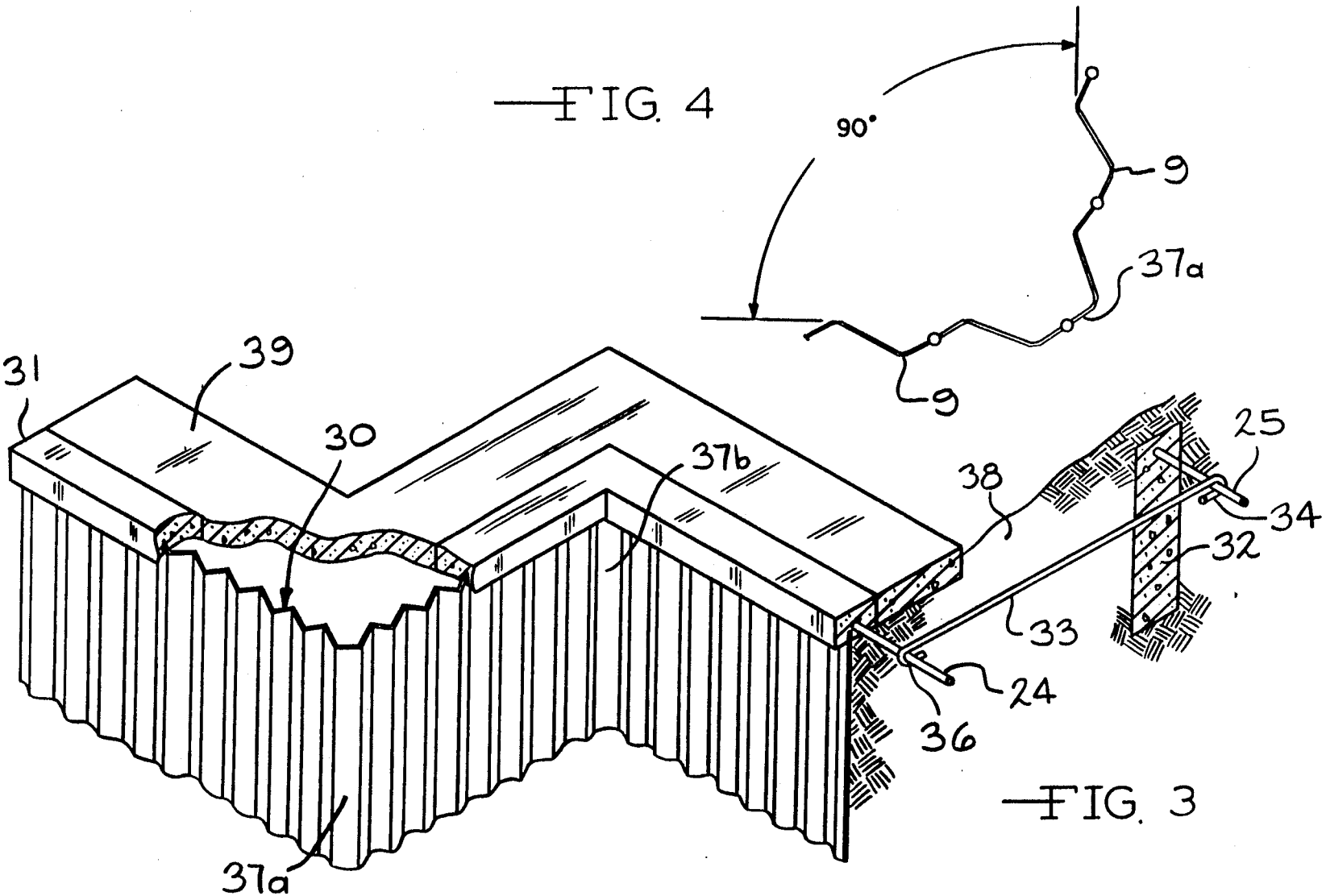
FIG. 3 illustrates an assemblage of panel strips of the invention forming a seawall with a deep "V" cross sectional shape as in FIG. 1 with a concrete cap at the top and a tie rod connection to an embedded anchor.
FIG. 4 illustrates the arrangement of a deep "V" profile wall made of the panel strips of the present invention showing how a box rib corner can provide a 90 degree turn in the wall.
Figure 5:
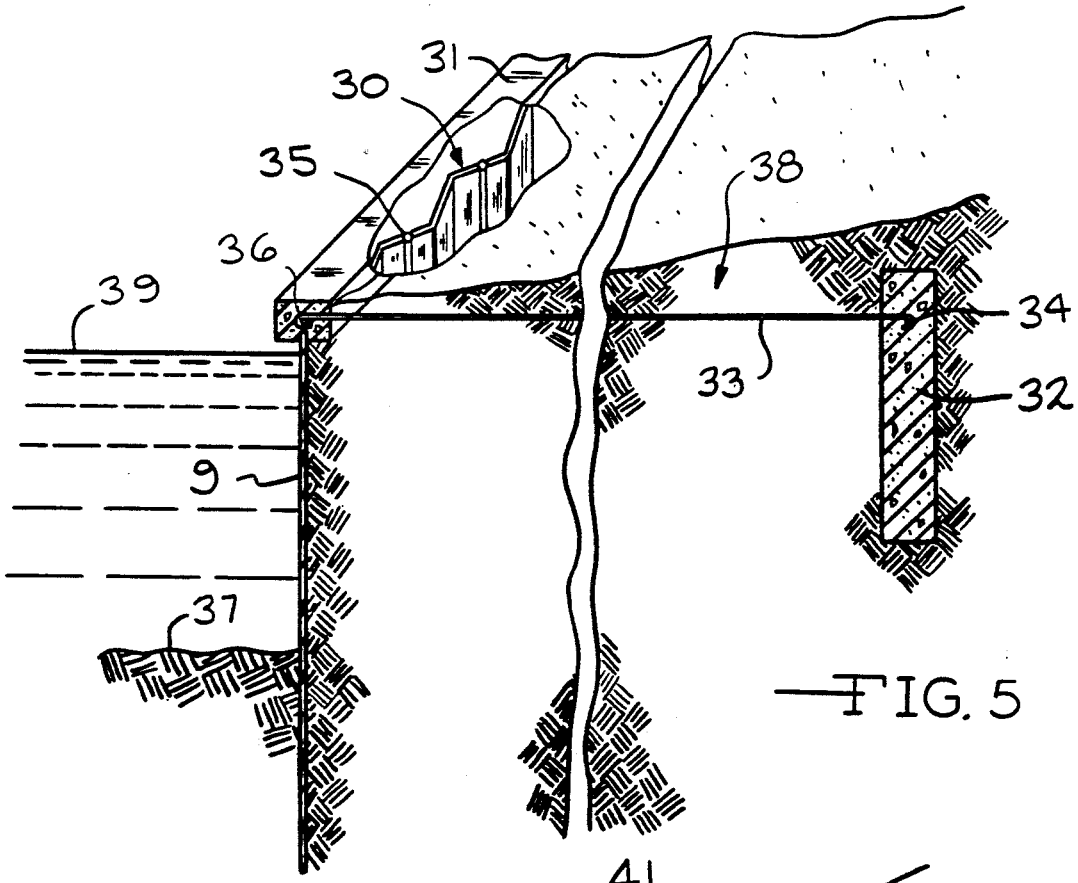
Figure 6:
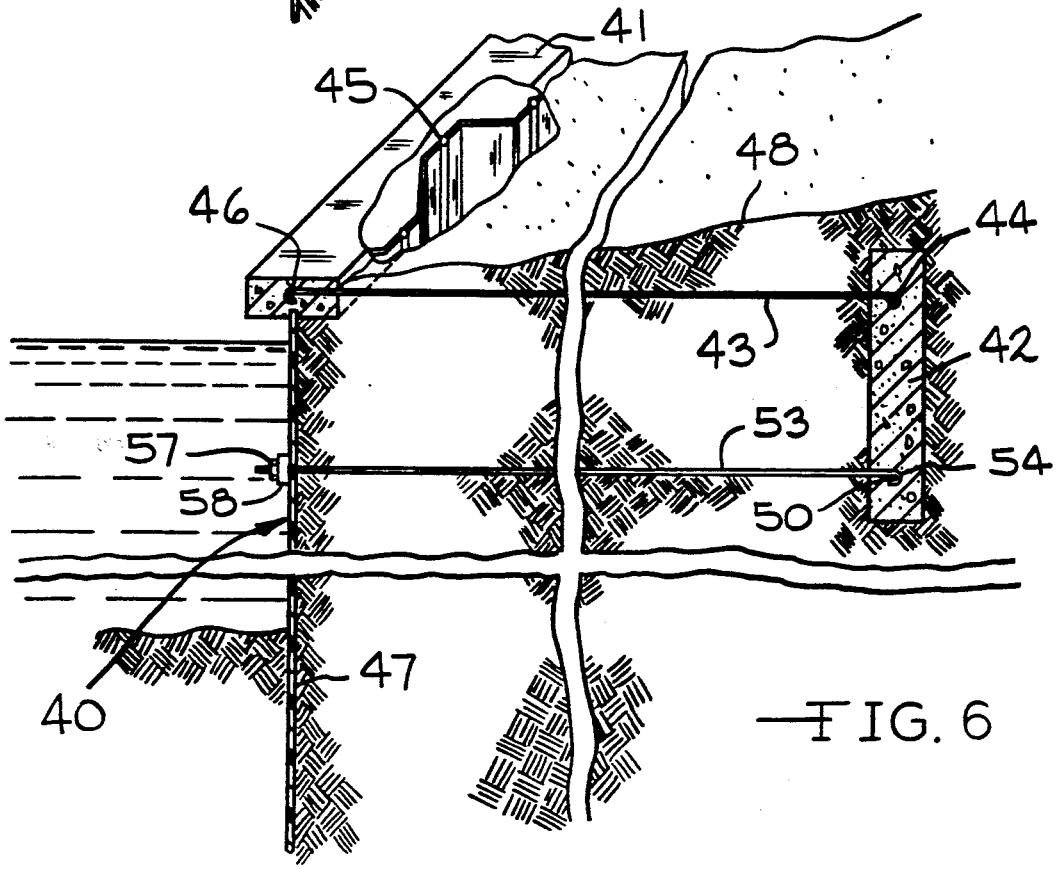

FIG. 5 is another illustration of a deep "V" wall construction similar to that shown in FIG. 3 illustrating how the panel extends down in anchored relation below the water level of the shoreline on which it is constructed; and FIG. 6 is an illustration of a seawall having a box rib cross sectional shape for a deeper seawall having a whaler and additional tie rods for greater strength and resistance to erosion.

Figure 1:
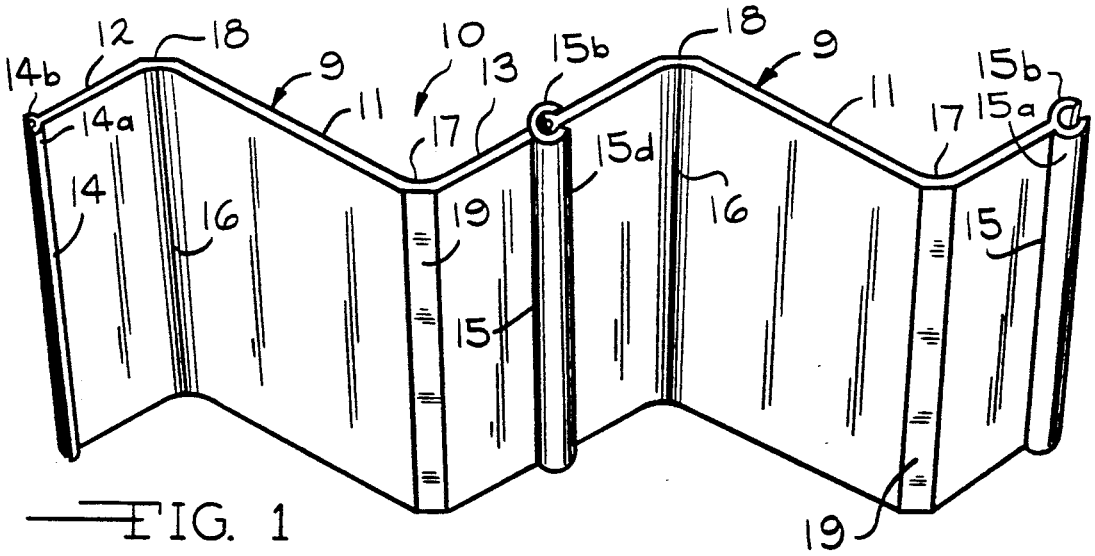
FIG. 1 shows two panel strips of the invention in side-by-side interlocked relation illustrating a cross section having a deep "V" wall configuration.
Figure 1A:
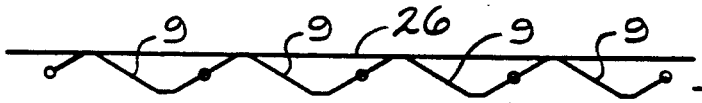
FIG. 1A is a schematic illustration showing in top profile the assembly of a series of four panel strips in a deep "V" wall configuration with a whaler such as a wooden or plastic bar extending along one side.

Referring to the drawings in greater detail, FIG. 1 illustrates an assemblage of panel strips 9 assembled in interlocked relation to form a deep "V" wall configuration wherein the central body section 11 or central web of the strip has two side sections or extensions 12 and 13. The side section 12 connected to the body section 11 provides a male interlocking edge 14, a somewhat semicircular configuration having a short extension 14*a* on one side of section 12 and a short extension 14*b* on the other side of section 12. Similarly the side section 13 at the opposite edge of the panel strip parallel to the side section 12 has a female interlocking portion 15 extending along its edge also symmetrically arranged with an extension 15*a* on one side of the side section 13 and extension 15*b* on the other side forming the housing or nest for the female interlock 15 within which the male portion 14 can slide from top to bottom to from the interlocked relation between the two panels. The angle between the body section 11 and the side sections 12 and 13 respectively, is in an obtuse angle range of 90 degrees to less than 180 degrees, but preferably is in the order of 120 degrees as illustrated. To avoid stress creating point contacts by whalers, the outermost corners of the panels 18 and 19 are flat shaped regions from top to the bottom of the strip thereby establishing a flat solid area for contact of the panel strips by the strength imparting whalers 26 extending across the outside of a wall as shown schematically in FIG. 1A.

Figure 2A:
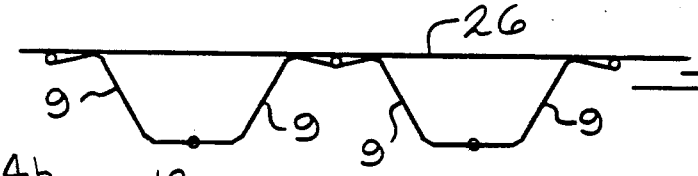
FIG. 2A is a schematic illustration showing in top profile the assembly of a series of four panel strips in a box ribbed wall configuration with a whaler extending along the wall in secured relation to one side thereof.
Figure 2:
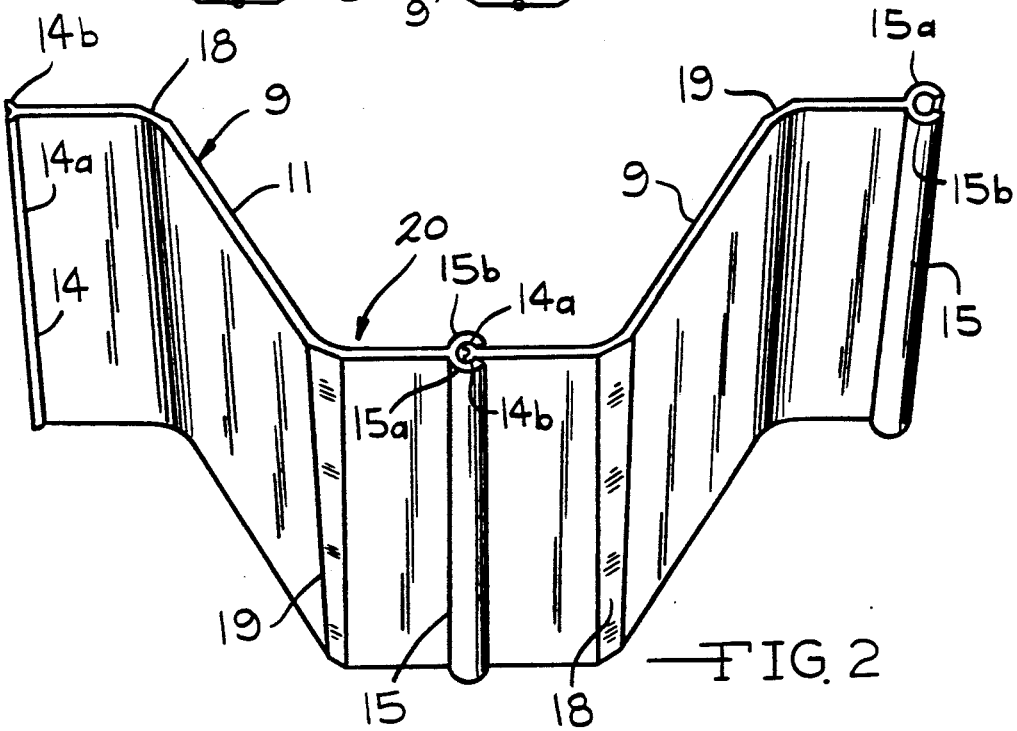
FIG. 2 shows two side-by-side interlocked panel strips of the invention with one upside down relative to the next illustrating a cross sectional shape of box rib construction.

FIG. 2 illustrates the same panel strip 9 as shown in FIG. 1 assembled with an adjacent like panel 9 inverted so that the top and bottom are interchanged in their interlocked association thereby forming a box rib wall configuration. As will be seen in the right side panel strip 9 the interlock, extensions 15*a* and 15*b* are interchanged relative to the position of the similar extensions of the female interlock 15 in the left hand strip. Likewise the male portions 14*a* and 14*b* in the right side panel strip 9 are interchanged relative to the similar portions 14*a* and 14*b* in the left side panel strip 9. The flattened corners or shoulders 18 and 19 and the right side panel strip are also inverted relative to the shoulders 18 and 19 in the left side strip.

As shown schematically in FIG. 2A, the slight lateral flexibility of the individual strips permit the box ribbed configuration to give slightly at the region of the interlock 15 of interconnected panels when a whaler 26 is extended in secured relation across one side. The slight flex further bends the flattened corner of each strip toward a more flush facing relation with the whaler thereby reducing the tendency toward excessive stress producing point contacts.

The plastic panel strips of the invention are preferably made of a vinyl resin such as that sold by B. F. Goodrich Corporation under the name "GEON", a trademark of B. F. Goodrich. Such resin has been found to be strong and highly weatherable and of properties well adapted to providing coastline protection.

When such panels are assembled in a deep "V" wall construction as illustrated in FIG. 1, it has been determined, by way of example, to have a relative stress to strain section modulus or stiffness index of 1.479 compared to 5.005 for the box ribbed wall assembly of the same panel strips because of the differences in the geometrical designs. Variables, among others, which dictate whether one or the other of such wall constructions is utilized are soil conditions, loads, and wave and weathering action. For heavier loads, or uncertain conditions, the box ribbed design is preferable.

By way of example without intention to be limiting, in an actual construction of panels according to this invention panel strips have been made having a dimension across the top of the configuration in the order of 12". With the deep "V" design and 120 degree angle at the corners 16 and 17, two panels assembled in interlocked relation next to each other as in FIG. 1 will provide a 24" width coverage. The thickness of the deep "V" wall construction is then in the order of 3" whereas the cross section of a box rib design made of the same such panel strips will have a 6" depth and a 21" width coverage, 12½% less than the "V" configuration wall.

FIG. 3 shows a deep "V" configurated wall 30 having an outer corner 37*a* and inner corner 37*b* made of the same panel strips. The seawall is provided with a poured concrete cap 31 into which the top edge of the wall is embedded. Although wood or resin type whalers might be used to hold the top edge of the wall, the poured concrete cap is preferred to provide a holding of each incremental segment of the top of the wall thereby distributing the holding force and minimizing possible stress imparting point contacts.

An adjacent concrete strip 39 is shown extending adjacent and along the length of the cap 31 both to provide a means of mobility along the length of the wall as well as to hold adjacent ground portions in place in the event of wave action over the wall. Gravel such as pea stone gravel which will assist in providing drainage downwardly and to effect distribution of ground stresses is filled in behind the wall 30. The ground 38 extends in an upward inclination in usual form along the seawall and the concrete anchor 32 is provided a distance back from the seawall extending along its length and embedded below the level of ground 38. A tie rod 33 assists in holding the wall in place by being connected to a reinforcing rod embedded in the cement cap 31 when it is formed and extending back to a similarly embedded reinforcing rod 25 embedded in the concrete anchor 32. The tie rod can be connected between the two reinforcing rods 24 and 25 by merely bending the ends about the rods as illustrated in FIG. 3.

The female interlock which in cross section is "C" shaped with the gap or opening between the ends of the "C" being sufficiently wide to accommodate the wall thickness of an adjacent interlocked panel strip. The gap is enough opening to permit a bending alignment of an adjacent panel without flexing the panels but small enough that the male portion is retained and prevented from slipping out from the female gap opening. In other words adjacent panels are provided a degree of bend in their interlocked association to accommodate some incongruities in ground profile contours. For example a gap in the female interlock allowing an adjacent panel bend in a range up to 12½ degrees in either direction from a straight line association has been found desirable. Such a range of bending adjacent panel strips proves advantageous both in assisting matching of ground incongruities as well as in allowing turns, including 90 degree turns with a series of adjacent selectively inverted side-by-side panels in box ribbed as well as in deep "V" shaped wall assemblies. The additional slight lateral flex or bend possible within each strip itself further assists in permitting formation of wall adjustments to needed nonstraight alignments and bends in a wall assembly.

FIG. 4 illustrates more clearly how a deep "V" wall made of the panel strips 9 can be assembled to provide a 90 degree angle or corner such as at an outside corner 37*a* or an inside corner 37*b* in FIG. 3. In this regard the deep "V" wall is ended and a corner is formed by inverting an adjacent panel 9 which results in providing a turn. Where the wall turn thus provided is not completely 90 degrees the amount of bending in alignment allowed at the joint allows progressive incremental bending at interlocking joints to form the 90 degrees turn or slight variation therefrom desired. After the first inversion of an adjacent panel strip 9 the remaining panel strips 9 are maintained in their upright fashion so that a continuance of the deep "V" wall construction is provided after only one inversion of a panel strip 9.

The above points out another aspect of the invention in that as desired a continuous wall might be alternately made with the sawtooth deep "V" configuration or the box ribbed configuration, depending on needs for strength and nonstraight alignments in shorelines. The assembly of a box ribbed wall differs from assembly of the deep "V" wall construction only in that in the box rib arrangement alternate panel strips are inverted top to bottom to produce the box ribbed effect.

FIG. 5 shows a seawall 30 of deep "V" configuration with interlocking edges 35 and a poured concrete cap 31 adjacent a body of water 39. In this arrangement the concrete anchor 32 embedded in the ground 38 has a tie rod 33 extending thereto from the concrete cap 31 in which a reinforcing rod 24 running the length of the cap provides an anchor for the tie rod 33 which has its end 36 bent and clamped around the reinforcing rod 24. Similarly the other end of the tie rod 33 has its end 34 bent and clamped about a reinforced rod 25 running the length of the concrete anchor 32 as well.

FIG. 6 shows how a seawall of greater height than shown in FIG. 5 for a deeper water shoreline can be provided by provision of additional lower level tie rods 53. The wall 40 of ribbed construction with adjacent strips interlocked at joints 45 provide greater strength than the deep "V" wall. Correspondingly a poured concrete cap 41 in which the assembled panel top is embedded is sufficiently wide to accommodate the greater width of the box rib construction. The tie rods 43 extend between a reinforcing rod in the cap 41 about which they are bent and clamped at ends 46 while the opposite 44 of the tie rods 43 are clamped about a reinforcing rod 42 running the length of the concrete anchor 42 embedded below the level of the ground 48. Additional tie rods 53 are provided below the level of the tie rods connected to the cap 41 to impart greater strength to the deeper wall 40. The wall 40 extends down below the ground level under water. It is anchored there to a depth necessary to provide the bottom support for the wall. Where the tie rods 53 extend to ends 54 they are bent and clamped about a reinforcing rod 50 extending along the length of the concrete anchor while the opposite ends are threaded and secured by nuts 57. The tie rods at the water's edge extend through a whaler 58 which runs the length of the wall while the tie rods 53 are provided at space distances along the length of the wall depending upon the strength to be imparted and required to hold the whaler 58 in place.

As pointed out, because of the light weight of the panels in formation of such a wall the euipment necessary to pound them into the soil under water can be relatively simple tool mechanisms such as pneumatic hammers, comparatively light weight automatic hammers which can pound the top of the panels with pounding caps mounted thereon or ground disrupting water jets extending downwardly from longitudinal tubes on opposite sides of the base of each panel during installation to make way for the panel.

In view of the foregoing it will be understood that many variations of the arrangement of our invention can be provided within the broad scope of the principles embodied therein. Thus, while particular preferred embodiments of our invention have been herein shown and described, it is intended by the appended claims to cover all such modifications which fall within the true spirit and scope of the invention.

I claim:

1. A structural panel for construction of ground erosion barriers for seawalls and the like formed of synthetic resin material selected for its ability to withstand soil shifts, weather changes, and wave action to which it is to be subjected in a barrier installation, said panel being relatively narrow compared to its length and comprising in cross section a central body section with two parallel side sections extending therefrom in the opposite directions, said side sections extending in opposite but parallel directions with equal obtuse angles between said side sections and said central body section thereby forming a generally "V" shaped configuration in opposite faces said panel, one of said oppositely extending side sections having a male interlocking edge and the other having a matching female interlocking edge, whereby adjacent such panels can be interlocked to form a continuous barrier wall of a series of said panels, said male and female interlock edges being shaped to form a straight-line aligned relationship between adjacent side sections of adjacent interlocked panels of such a series both when adjacent panels are interconnected with all similar ends designated as top ends located in the upper region of the barrier providing one cross sectional profile as well as when alternate panels in such a series are inverted with their top ends at the bottom of the barrier providing a different cross sectional profile.

2. A panel as set forth in claim 1 which is capable of being flexed to a slight degree without extending beyond a yield strength to provide a degree of flex for nonstraight alignments and bends in continuous walls of said panels.

3. A ground retaining barrier formed of a series of interconnected panels like that set forth in claim 1 in which said interconnected panels are each arranged with immediately adjacent "V" shaped face portions being in opposite faces of said barrier thereby forming a secondary composite deeper "V" cross sectional configuration of each pair of adjacent panels in said barrier assembly.

4. A ground retaining barrier formed of a series of interconnected panels like that set forth in claim 1 in which said interconnected panels are arranged with immediately adjacent "V" shaped face portions being in the same face of said barrier thereby imparting a box ribbed cross sectional configuration to said barrier assembly.

5. A ground retaining barrier formed of a series of interconnected panels like that set forth in claim 1 in which alternate panels in said series of interconnected panels are inverted orientation with their tops being located at the bottom relative to those panels in between thereby imparting a box ribbed cross sectional configuration to said assembly.

6. The ground retaining barrier formed of a series of interconnected panels like that set forth in claim 1 in which the bottom edge of said assembly of side-by-side laterally aligned interconnected panels is embedded in the ground to hold said bottom edge in solid assembled association.

7. A ground retaining barrier as set forth in claim 6 in which a poured cap of cement-like material is provided extending along the length of the top of said barrier in which the top edge of said series of assembled panels is solidly embedded to hold each incremental section of said top egde in its interconnected association with other panels of said barrier.

8. A ground retaining barrier as set forth in claim 4 in which said poured cap has reinforcing means embedded therein.

9. A ground retaining barrier as set forth in claim 8 including at least one tie rod is connected to said reinforcing means extending to anchoring means spaced from said barrier.

10. A ground retaining barrier as set forth in claim 9 in which a whaler is provided extending across the face of said barrier wall in a region between said barrier and the ground in which said bottom edge is held.

11. A panel as set forth in claim 1 in which the female interlock edge of said panel in cross section is C-shaped of a size to accommodate in mated interlocked relation a male interlock edge of an adjacent similar panel.

12. A panel as set forth in claim 11 in which said C-shaped female interlock has a gap between the edges of its "C" cross section shape of sufficient size to allow at least small angular alignment of an adjacent mated interlocked panel while still retaining a positive interlocked relation with said adjacent mated panel.

13. A panel as set forth in claim 12 in which the gap in the C-shaped interlock of each of the panels in said barrier assembly is sufficiently large to allow up to a 12½ degree bend in either direction from a straight line alignment between adjacent panels without flexing said panels.

* * * * *

US005145287B1

REEXAMINATION CERTIFICATE (4030th)

United States Patent [19] [11] B1 5,145,287

Hooper et al. [45] Certificate Issued Apr. 4, 2000

[54] PLASTIC PANEL EROSION BARRIER

[75] Inventors: Jefferson E. Hooper, Lake Arthur, La.; John E. Irvine, Granger, Ind.

[73] Assignee: Materials International, Inc., Lake Charles, La.

Reexamination Request:
No. 90/004,954, Apr. 3, 1998

Reexamination Certificate for:

| | |
|---|---|
| Patent No.: | **5,145,287** |
| Issued: | **Sep. 8, 1992** |
| Appl. No.: | **07/667,273** |
| Filed: | **Mar. 11, 1991** |

[51] Int. Cl.[7] ..... E02D 7/20; E02D 5/00

[52] U.S. Cl. ..... 405/262; 405/274; 405/281; 405/284

[58] Field of Search ..... 405/278–281, 405/262

[56] References Cited

U.S. PATENT DOCUMENTS

| | | | |
|---|---|---|---|
| 1,884,686 | 10/1932 | Hilpert . | |
| 3,822,557 | 7/1974 | Frederick . | |
| 4,674,921 | 6/1987 | Berger . | |
| 4,863,315 | 9/1989 | Wickberg . | |
| 4,917,543 | 4/1990 | Cole et al. | 40/281 X |

OTHER PUBLICATIONS

*Steel Sheet Piling Handbook*, Reference Data on Shapes, Materials, Performance and Applications, United States Steel, Jul. 1975, pp. 11–101.

*Steel Sheet Piling*, United States Steel, 1960, pp. 7–55.

*Primary Examiner*—Dennis L. Taylor

[57] ABSTRACT

A plastic structural panel and ground erosion barrier made therefrom in which the panel is in strip form relatively narrow compared to its length and which in general is a stretched Z-shaped cross sectional design with opposed male and female interlock edges for mating association with adjacent panel strips. The panel strip design has a "V" configuration on opposite faces and allows optional top-to-top alignment of adjacent panels for a composite deep "V" cross sectional shaped wall or alternate top-to-bottom turnover of adjacent panel strips to provide a thicker box ribbed cross sectional shape for the wall. The composite deep V-shaped cross section provides a greater breadth of coverage but less section modulus than the box ribbed construction. By incorporating in the design a capability of a slight flex in the panel and by forming the female interlock sections with a gap allowing alignment of adjacent panels with a small angular degree orientation, a number of wall bends or configurations can be imparted to wall constructions without need for extra components or different shaped panel strips for bends or noncomformities in alignment of the wall construction.

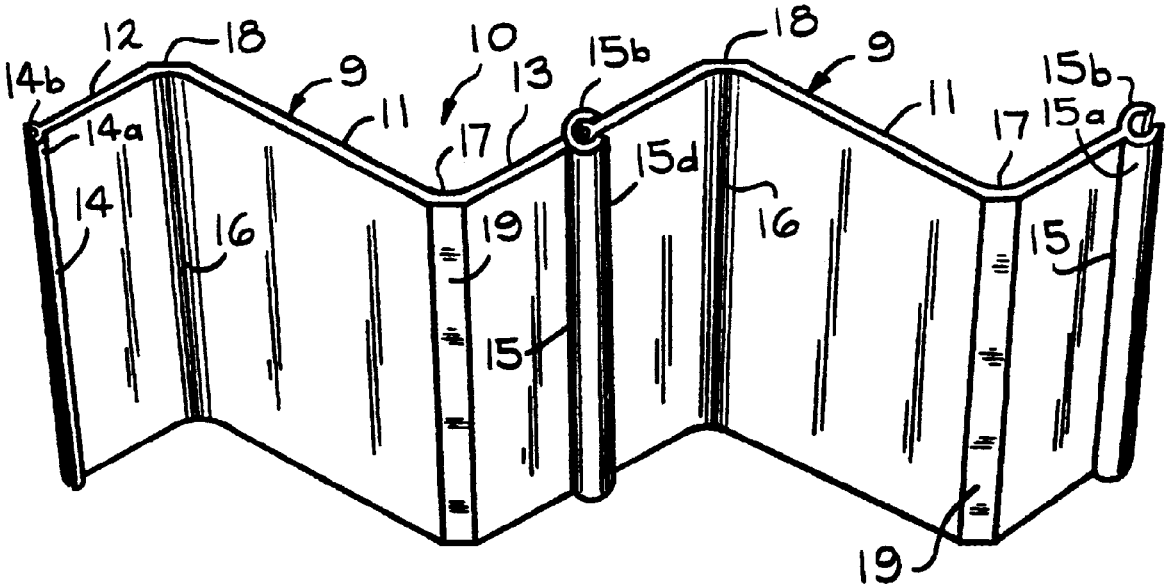

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 7 and 8 are determined to be patentable as amended.

Claims 2–6, 9–13, dependent on an amended claim, are determined to be patentable.

New claim 14 is added and determined to be patentable.

1. A structural for construction of ground erosion barriers for seawalls and the like formed of synthetic resin material selected for its ability to withstand soil shifts, weather changes, and wave action to which it is to be subjected in a barrier installation, said panel being relatively narrow compared to its length and comprising in cross section a central body section with two parallel side sections extending therefrom in [the] opposite directions, said side sections extending in opposite but parallel directions with equal obtuse angles between said side sections and said central body section thereby forming a generally "V" shaped configuration in opposite faces *of* said panel, one of said oppositely extending side sections having a male interlocking edge and the other having a matching female interlocking edge, whereby *duplicate* adjacent such panels can be interlocked to form a continuous barrier wall of a series if said panels, said male and female interlock*ing* edges being shaped *with respect to their side sections* to form a straight-line aligned relationship between adjacent side sections of adjacent interlocked panels of such a series *of said panels* both when adjacent panels are interconnected with all similar ends designated as top ends located in the upper region of the barrier providing one cross sectional profile as well as when alternate panels in such a series are inverted with their top ends at the bottom of the barrier providing a different cross sectional profile.

7. A ground retaining barrier as set forth in claim 6 in which a poured cap of cement-like material is provided extending along the length of the top of said barrier in which the top edge of said series of assembled panels is solidly embedded to hold each incremental section of said top [egde] *edge* in its interconnected association with other panels of said barrier.

8. A ground retaining barrier as set forth in claim [4] *7* in which said poured cap has reinforced means embedded therein.

*14. A panel as set forth in claim 1, wherein outermost corners are formed at the intersection of said central body section and each of said parallel side sections, said outermost corners of said panel being flat shaped regions from top to bottom of said panel establishing a flat solid area of contact of said panel for placement against a whaler.*

* * * * *